US005180967A

United States Patent [19]

Yamazaki

[11] Patent Number: 5,180,967

[45] Date of Patent: Jan. 19, 1993

[54] CONSTANT-CURRENT SOURCE CIRCUIT HAVING A MOS TRANSISTOR PASSING OFF-HEAT CURRENT

[75] Inventor: Seiichi Yamazaki, Tokyo, Japan

[73] Assignee: Oki Electric Industry Co., Ltd., Tokyo, Japan

[21] Appl. No.: 748,661

[22] Filed: Aug. 22, 1991

[30] Foreign Application Priority Data

Aug. 3, 1990 [JP] Japan ..... 2-229293

[51] Int. Cl.[5] ..... G05F 3/08

[52] U.S. Cl. ..... 323/315; 323/312

[58] Field of Search ..... 323/312, 315, 317

[56] References Cited

U.S. PATENT DOCUMENTS

| | | | |
|---|---|---|---|
| 4,078,199 | 3/1978 | Chapron et al. | 323/315 |
| 4,308,496 | 12/1981 | Nagano | 323/315 |
| 4,350,904 | 9/1982 | Cordell | 323/315 |
| 4,435,678 | 3/1984 | Joseph et al. | 323/315 |
| 4,442,398 | 4/1984 | Bertails et al. | 323/315 |
| 4,450,367 | 5/1984 | Whatley | 323/315 |
| 4,567,426 | 1/1986 | von der Plassche et al. | 323/315 |
| 4,769,589 | 9/1988 | Rosenthal | 323/315 |
| 4,792,750 | 12/1988 | Yan | 323/315 |
| 4,879,524 | 11/1989 | Bell | 323/315 |
| 4,890,052 | 12/1989 | Hellums | 323/315 |
| 5,038,053 | 8/1991 | Dienguerian et al. | 323/315 |

*Primary Examiner*—Steven L. Stephan
*Assistant Examiner*—Jeffrey Sterrett
*Attorney, Agent, or Firm*—Edward D. Manzo

[57] ABSTRACT

There is provided a constant-current source having first current mirror circuit, connected between a first fixed voltage terminal and first and second nodes, having a first current gain; the first mirror circuit passing a first current through the first node based upon the first fixed voltage and passing a second current through the second node in accordance with the first current gain; a second current mirror circuit, connected both to the first and the second nodes, having a second current gain; the second current mirror circuit passing the second current through the second node and passing a third current in accordance with the second current gain based upon the first current passing through the first node; a current gain variation circuit, connected between the second current mirror circuit and a second fixed voltage terminal, for varying the second current gain in accordance with variation of the third current; a first activating circuit, connected between the first fixed voltage terminal and the first node, for passing a first off-leak current through the first node in accordance with the first current; a second activating circuit, connected between the second fixed voltage terminal and the second node, for passing a second off-leak current through the second node in accordance with the second current; and an output circuit, connected between an output terminal and the first fixed voltage terminal, for outputting a constant current.

23 Claims, 3 Drawing Sheets

CONSTANT-CURRENT SOURCE CIRCUIT HAVING A MOS TRANSISTOR PASSING OFF-HEAT CURRENT

BACKGROUND OF THE INVENTION

1. Field of the Invention

The present invention relates to a constant-current source circuit employed in a CMOS semiconductor integrated circuit and, more particularly, to a self-activated constant-current source circuit.

2. Description of the Related Art

The conventional constant-current circuit is exemplified in the laid-open Japanese Patent Publication No. 293327/1987.

The constant-current source circuit disclosed above outputs constant current Ic at an output terminal OUT in accordance with power source voltage $V_{DD}$, and incorporates a first and a second current mirror circuits connected to a power source voltage terminal and ground respectively, a resistor connected to the second current mirror circuit, and P channel type MOS FET (hereinafter called as PMOS transistor) connected to the first current mirror circuit.

The first current mirror circuit has current gain G1 greater than one.

The second current mirror circuit has current gain G2 which varies from 1 to ½ depending on a voltage drop across the resistor.

Since the resistor passes the current of the second current mirror circuit to ground, the voltage drop across the resistor varies depending on current variation of the second current mirror circuit.

The resistor constitutes a closed-loop circuit in combination with the first and the second current mirror circuits.

The PMOS transistor outputs constant current Ic at an output terminal OUT in accordance with the current passing through the first current mirror circuit.

This PMOS transistor constitutes a current mirror circuit in combination with the PMOS transistor in the first current mirror circuit.

The above mentioned constant-current source circuit is connected to an activation device which generates an external activation signal.

This activation device includes a detector for detecting supply of power source voltage $V_{DD}$ and a trigger generator for generating an external trigger activation signal in response to the detected result of the detector.

To activate the constant current source circuit, the power source voltage $V_{DD}$ is applied to a prescribed terminal and the external activation signal is applied from the outside activation device to the first and the second current mirror circuit, whereby the constant-current source circuit operates in a stabilized condition at the operating point where the product of the current gain of the first current mirror circuit by the current gain of the second current mirror circuit determined by the resistor equals to one.

On this instance, the current passing in the closed-loop circuit, which is constituted by the first and the second current mirror circuits and the resistor, can be outputted at the output terminal OUT as the constant current Ic through the current mirror circuit which is constituted by the PMOS transistor and the PMOS transistor of the first current mirror circuit.

In the constant-current source circuit described above, when two NMOS transistors of the second current mirror circuit are operated in a weak inversion region by adequetly designing those gate widths and gate lengths, the product of the constant current Ic and the resistance value of the resistor is proportional to the absolute temperature.

Accordingly, when the constant-current Ic passes through a resistor, the voltage drop across the resistor is in proportion to absolute temperature.

As the result, the constant-current source circuit can output constant current Ic and can also be easily incorporated into CMOS integrated circuits as a standard voltage source having low power consumption.

The constant-current source circuit described above has, however, following problems to be solved.

Since the external signal is provided when the constant-current source circuit is to be initiated, the activation device must be incorporated to generate the external signal.

The activation device comprises a detector for detecting power source voltage $V_{DD}$ and a trigger generator for outputting the external signal, which is complicated in structure.

The activation device has another problem that if power source voltage $V_{DD}$ varies slowly when the power is supplied, the power supply cannot be detected.

On this occasion, since the closed-loop circuit including the first and the second current mirror circuits and the resistor does not function stably so as to generate constant-current Ic, no current passes in the closed-loop circuit, that is, all of PMOS and NMOS transistors in the first and the second current mirror circuits turn to be "off" state.

Another activation method for the constant-current source circuit has been proposed which utilizes parasitic capacitance of PMOS and NMOS transistors constituting the first and the second current mirror circuits.

In this method, however, since the activating operation depends on when power source voltage $V_{DD}$ is applied, the activating operation may fail depending on how power source voltage $V_{DD}$ is supplied.

There is also a possibility that the activating operation becomes unstable due to manufacturing variation of parasitic capacitors.

SUMMARY OF THE INVENTION

Accordingly, it is a primary object of the present invention to provide an improved constant-current source circuit which does not necessitate an input of an external signal in the activating operation.

Another object of the present invention is to provide a constant-current source circuit which performs stably.

A further object of the present invention is to provide a constant-current source circuit which, in addition to the foregoing objects, accurately activates the first and the second current mirror circuits by way of an off-leak current being large enough not to deteriorate the circuit operation after activation.

To accomplish the above objects, there is provided a constant-current source circuit employing a first current mirror circuit, connected between a first fixed voltage terminal and first and second nodes, having a first current gain; the first mirror circuit passing a first current through the first node based upon the first fixed voltage and passing a second current through the second node in accordance with the first current gain; a second current mirror circuit, connected both to the first and the second nodes, having a second current gain; the second current mirror circuit passing the second current through the second node and passing a third current in accordance with the second current gain based upon the first current passing through the first node; a current gain variation means, connected between the second current mirror circuit and a second fixed voltage terminal, for varying the second current gain in accordance with variation of the third current; a first activating means, connected between the first fixed voltage terminal and the first node, for passing a first off-leak current through the first node in accordance with the first current; a second activating means, connected between the second fixed voltage terminal and the second node, for passing a second off-leak current through the second node in accordance with the second current; and an output means, connected between an output terminal and the first fixed voltage terminal, for outputting a constant current.

BRIEF DESCRIPTION OF THE DRAWINGS

These and other objects will become more apparent when a preferred embodiment of the present invention is considered in connection with the drawings, in which.

DETAILED DESCRIPTION OF THE PREFERRED EMBODIMENTS

Figure 1:
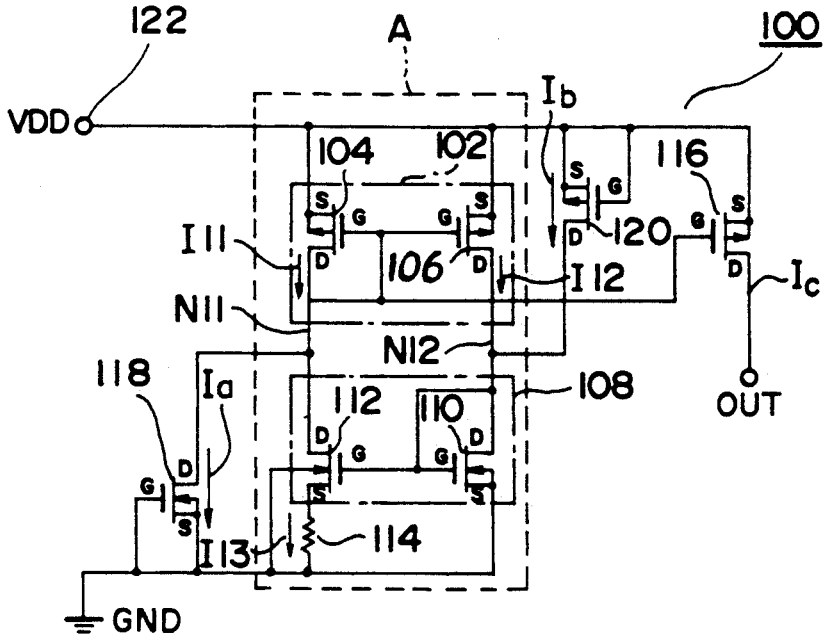
FIG. 1 is a circuit diagram of a constant-current source circuit illustrating a first embodiment according to the present invention.

Referring to FIG. 1, constant-current source circuit 100, which incorporates first current mirror circuit 102 and second current mirror circuit 108, inputs 5 V power source voltage and outputs constant-current Ic to an output terminal OUT.

At first current-mirror circuit 102 having a current gain G11 incorporates a first PMOS transistor 104 which passes a first current I11 from a power source voltage $V_{DD}$ and a second PMOS transistor 106 which passes a second current I12 multiplied by current gain G11 to first current I11.

Both gates of the first and second transistors 104 and 106 are commonly connected to the drain of the transistor 104 and the first node N11.

The source and the substrate of the first and second PMOS transistors 104 and 106 are commonly connected to a power source voltage terminal 122.

The drain of the second transistor 106 is connected to a second node N12.

In case where the gate width is W and the gate length is L, the ratios W/L of transistors 104 and 106 are respectively set to 20/10, 40/10 (μm/μm) so that each of the transistors 104 and 106 can operate in a strong inversion region.

A second current mirror circuit 108 is connected, through the first and second nodes N11 and N12, to the first current mirror circuit 102. The second current mirror circuit 108 having a current gain G12 incorporates a third NMOS transistor 110 which passes the second current I12 through the second node N12, and a forth NMOS transistor 112 which passes a third current I13 which equals the current gain G12 multiplied by the current passing through the third transistor 110.

Each gate of the third and fourth transistors 110 and 112 are commonly connected to the drain of the third transistor 110 and the node 12. The drain of the third transistor 112 is connected to the second node N11.

The source and the substrate of the third transistor 110 and the substrate of the fourth transistor 112 are respectively connected to ground.

The ratios W/L of the third and fourth transistors 110 and 112 are respectively set to 300/10, 300/10 (μm/μm) so that each of transistors 110 and 112 can operate in a weak inversion region.

A resistor 114 having a resistance of 1 MΩ is connected between the source of transistor 112 and ground.

A closed loop circuit A includes the current mirror circuits 102 and 108 and the resistor 114.

A fifth PMOS transistor 116, which constitutes a third current mirror circuit in combination with the first transistor 104, is connected between a power source voltage terminal 122 and the output terminal OUT. A source, a drain and the gate of the fifth transistor 116 are respectively connected to the power source voltage terminal 122, the output terminal OUT and the node N11.

The ratio W/L of the fifth transistor 116 is set to 200/10 (μm/μm).

Further, a sixth NMOS transistor 118 and a seventh PMOS transistor 120 for activation are respectively connected to the nodes N11 and N12.

Sixth transistor 118, the gate, the source and the substrate of which are commonly connected to ground. The drain of the sixth transistor 118 is connected to node N11. The sixth transistor 118 provides a first "off"-leak current Ia to the first node N11.

The sixth transistor 118 is designed such that the channel length (gate length L) is as it can be as possible as it can be and the ratio W/L thereof is set few times larger than that of the first transistor 104. In the embodiment, the ratio W/L is 20/1.2 (μm/μm).

The seventh transistor 120, the gate, the source and the substrate of which are commonly connected to the power source voltage terminal 122. The drain of the seventh transistor 120 is connected to the node N12. The seventh transistor 120 provides second off-leak current Ib to the second node N12.

The seventh transistor 120 is designed such that the channel length (gate length L) thereof is as short possible and the ratio W/L thereof is set few times larger than that of the third transistor 110. In this embodiment, the ratio W/L is 200/1.2 (μm/μm).

The operation of the constant-current source circuit 100 will be hereinafter explained separately with a post-activation operation [1] and an activating operation [2].

Post activation operation [1]:

A voltage appearing across resistor 114, when being activated the closed loop A which is constituted by the first and second current mirror circuit 102 and 108 and resistor 114, is approximately 20 mV, so that the current I13 passing resistor 114 is approximately 20 nA.

Accordingly, in the closed loop circuit A, the current I11 which is approximately 20 nA passes through the drain of the first transistor 104.

Then, the current I12 which is approximately 40 nA passes through the drain of the second transistor 106 since the current gain G11 of the first current mirror circuit 102 equals to 2 due to the ratio W/L of the first and second transistors 104 and 106 being 2.

As explained above, the current I11 and the current I12 (which is equals the current gain G11 (=2) multiplied by the curent I11) pass through the current mirror circuit 102 and pass into the current mirror circuit 108 through the nodes N11 and N12.

In the current mirror circuit 108, the current gain G12 is reduced to approximately one half due to the voltage drop across the resistor 114 where the current I13 passes, whereby the product of the current gains G11 and G12 of the current mirror circuits 102 and 108 respectively becomes one (1) and the operation of the closed loop circuit A is stabilized.

When the circuit A is stabilized, the fifth transistor 116, which constitutes a current mirror circuit in combination with the first transistor 104, provides 200 nA as its constant drain current Ic which is 10 times larger than that of first transistor 104 at the output terminal OUT.

Activating operation [2]:

When power source voltage $V_{DD}$ is provided at the power source voltage terminal 122, the sixth and seventh transistors 118 and 120 remain off because the respective gates and sources of each are connected together.

However, since the sixth and seventh transistors 118 and 120 are designed such that the channel length L is short enough (1.2 μm), a certain amount of current, that is, first and second off-leak currents Ia and Ib, can be passed through the drains thereof even though the transistors 118 and 120 remain off.

In case that the power source voltage $V_{DD}$ is provided at the power source voltage terminal 122, that the closed loop circuit A is not activated and that the first, second, third and fourth transistors 104, 106, 110 and 112 all remain off, the second off-leak current Ib and the first off-leak current Ia are provided, respectively, to the nodes N12 and N11.

When the off-leak current Ib and Ia are respectively provided at the node N12 and N11, the off-leak current Ib is transferred through the current mirror circuit 108 to the drain of the fourth transistor 112.

The drain current of the fourth transistor 112 and the first off-leak current Ia of sixth transistor 118, is provided from the drain of the first transistor 104.

Further, the drain current of the first transistor 104 is transferred through the first current mirror circuit 102 to the drain of the second transistor 106.

Then, the drain current of the second transistor 106, which is combined with second off-leak current Ib, is provided to the drain of the third transistor 110.

The foregoing supply of current is occurred in the closed loop circuit A.

When, at the instance, the current passing through the closed loop circuit A is negligibly small compared to the voltage drop across the resistor 114, the circular current gain of the closed loop circuit A becomes 2 which is the product of current gain G11 (=2) of current mirror circuit 102 by current gain G12 (=1) of current mirror circuit 108, wherein current gain G11 equals to a of the ratios W/L ratio of transistors 104 and 106, and current gain G12 equals to a of the ratios W/L ratio of transistors 110 and 112.

Accordingly, the first and second off-leak current Ia and Ib are amplified in the closed loop circuit A so as to increase the current I13, which consequentially causes an increase of voltage drop across the resistor 114.

As the result, the voltage difference decreases between the source and the drain of the fourth transistor 112 and the current gain G12 of the second current mirror circuit 108 gradually decreases in response to the increase of current I13.

When the current gain G12 reaches to half value, the closed loop circuit A becomes stabilized operating condition, which is the state of post activation operation [1].

In such the manner explained above, the first and second off-leak current Ia and Ib activate the closed loop circuit A.

The embodiment described above has following advantages:

(A) Since the constant-current source circuit 100 includes the sixth transistor 118 and the seventh transistor 120 with the closed loop circuit A, an external signal is not required to activate the circuit.

The constant-current source circuit 100, on the contrary, can be activated by the first and second off-leak current Ia and Ib passing through the nodes N11 and N12, when the power source voltage $V_{DD}$ is applied.

Accordingly, the constant-current source circuit 100 can be achieved with simple circuit architecture, high reliability and stabilized activating operation.

Moreover, the constant-current source 100 can be stably activated, even though the power source varies gradually when power source voltage $V_{DD}$ is applied.

(B) Since the ratio W/L of the sixth transistor 118 is set to approximately 20/1.2 when the ratio W/L of the first transistor 104 is 20/10 and the ratio W/L of the seventh transistor 120 is set to approximately 200/1.2 when the ratio W/L of the third transistor 110 is 300/10, the off-leak currents of the first and second transistors 104 and 110 become larger respectively than off-leak current Ia of the sixth transistor 118 and the off-leak current Ib of the seventh transistor 120.

Accordingly, when the off-leak current Ib of the seventh transistor 120 is provided to the second node N12, the off-leak current Ib becomes larger than that of the third transistor 110, so that the current of the third transistor 110 can be transferred to the fourth transistor 112 even though the off-leak current Ib is less than that of the third transistor 110.

As the result, the second off-leak current Ib is accurately transferred to the fourth transistor 112 independent of manufacturing variation of the current gain G12 of the first current mirror circuit 102.

In the same way, since the first off-leak current Ia becomes larger than that of the first transistor 104, the current of the first transistor 104 is accurately transferred to the second transistor 106, so that the activation of the first and second current mirror circuits 102 and 108, that is, the activation of the constant current source circuit 100, can be securely performed.

Moreover, since the ratio W/L of the transistors 118 and 120 are selectively designed, accurate and stable activation can be guaranteed.

Further, the first and second off-leak currents Ia and Ib can be controlled when the constant current Ic is provided after activation.

(C) In the constant-current source circuit 100, the sixth transistor 118, which provides the off-leak current Ia to the first node N11, is an NMOS transistor and the seventh transistor 120, which provides the off-leak current Ib to the second node N12, is a PMOS transistor.

In this manner, to guarantee the stable activation of the constant-current source circuit 100 without being deteriorated by manufacturing variations, the constant-current source circuit 100 is designed such that the NMOS transistor 118 corresponds to the PMOS transistor 104 and the PMOS transistor 120 corresponds to the NMOS transistor 110.

(D) The first and second transistors 104 and 106 and the third and fourth transistors 110 and 112 which are respectively constitute the first and second current mirror circuits 102 and 108 are designed such that the gate length L is approximately 10 μm. Because the gate length is much longer than usual the voltage dependency between the drain and source of the drain current of each transistors can be extremely minimized.

The error of the current gain of the current mirror circuits 102 and 108, which is caused by the deviation of the voltage between the drain and source of the transistors 104 and 106 or the transistors 110 and 112 can be minimized.

As the result, there is provided a current mirror circuit featuring idealistic current mirror characteristics even though the gate length L is short.

Figure 2:
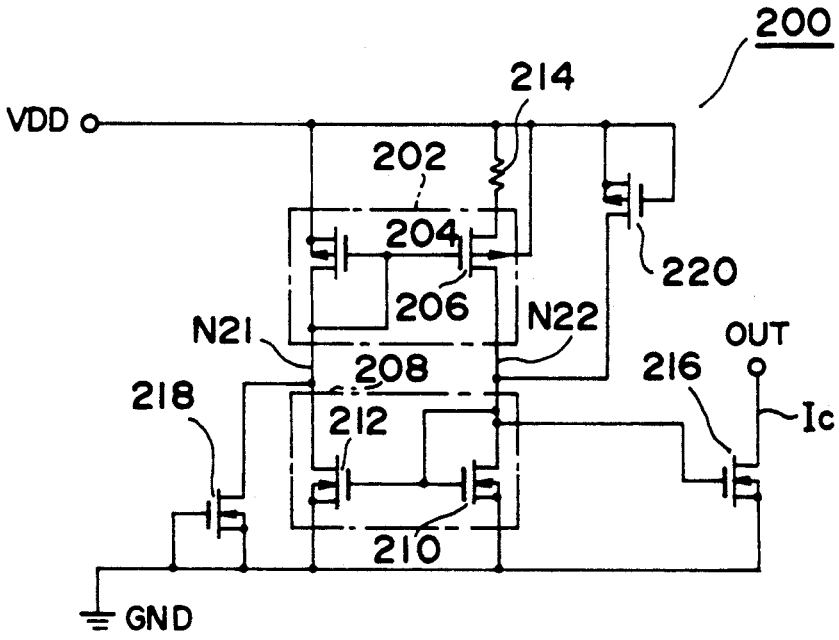
FIG. 2 is a circuit diagram of a constant-current source circuit illustrating a second embodiment according to the present invention.

FIG. 2 shows the second embodiment of the present invention, in which a constant-current source circuit 200 is designed such that the PMOS and the NMOS transistors in constant-current source circuit 100 illustrated in FIG. 1 are respectively substituted for NMOS and PMOS transistors, and the power source voltage VDD and ground are also transposed.

The constant-current source circuit 200 has a first current mirror circuit 202, a second current mirror circuit 208, a resistor 214, a fifth NMOS transistor 216, a sixth NMOS transistor 218 for activating and a seventh PMOS transistor 220 for activating.

The first current mirror circuit 202 has a first and a second PMOS transistors 204 and 206, whereas the second current mirror circuit 208 has a third and a fourth NMOS transistors, 210 and 212.

Each ratio W/L of transistors 204, 206, 210 and 212 is respectively 300/10, 300/10, 20/10 and 40/10 (μm/μm).

Each ratio W/L of the fifth, sixth and seventh transistors 216, 218 and 220 is respectively 200/10, 200/1.2 and 20/1.2 (μm/μm).

The second embodiment has approximately the same functions and results as those of the first embodiment, wherein the first and second transistors 204 and 206 operate in a weak inversion region.

Figure 3:
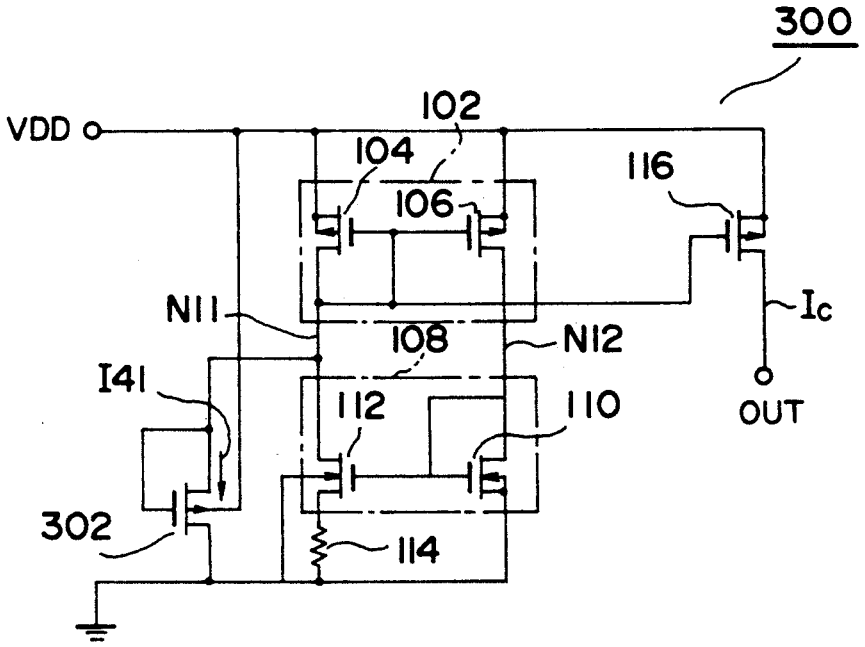
FIG. 3 is a circuit diagram of a constant-current source circuit illustrating a third embodiment according to the present invention.

FIG. 3 shows the third embodiment of the present invention, in which a constant-current source circuit 300 has a sixth NMOS transistor 302 for activating in place of the sixth and seventh transistors 118 and 120 in the constant-current source circuit 100 shown in FIG. 1. The sixth PMOS transistor 302, operating in approximately the same manner as of the sixth transistor 118, and being set such that the ratio W/L thereof is sufficiently large so as to provide a sufficient off-leak current I41, does not deteriorate the constant-current supplying operation after activation.

The third embodiment operates in approximately the same manner as of the first embodiment and the constant-current source circuit 300 has the above mentioned advantages (A), (B) and (D).

Figure 4:
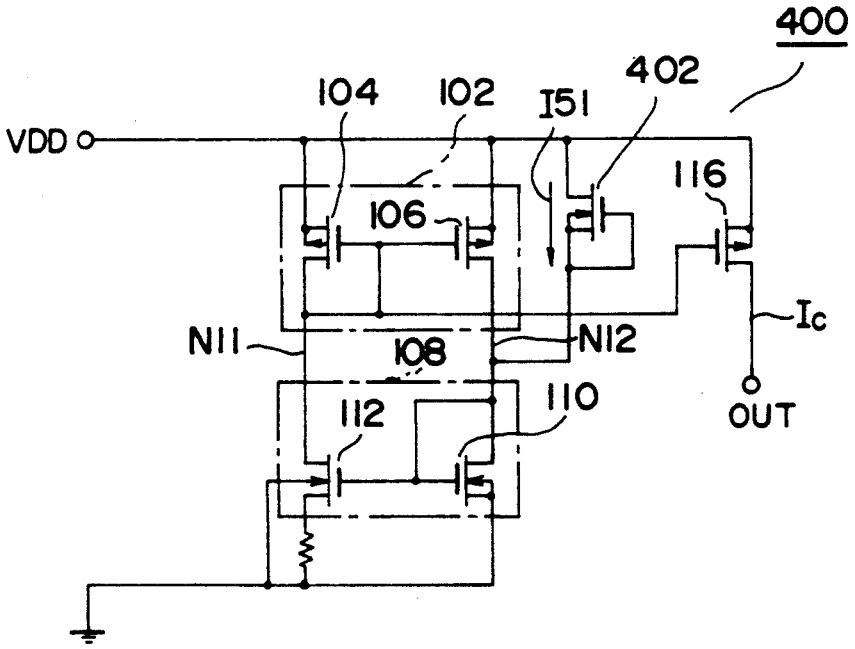
FIG. 4 is a circuit diagram of a constant-current source circuit illustrating a fourth embodiment according to the present invention.

FIG. 4 shows the fourth embodiment of the present invention, in which a constant-current source circuit 400 has a seventh NMOS transistor 402 for activating in place of the sixth and seventh transistors 118 and 120 in the constant-current source circuit 100 shown in FIG. 1. The seventh NMOS transistor 402 operating in approximately the same manner as of the seventh transistor 120, and being set such that the ratio W/L thereof is sufficiently large so as to provide a sufficient off-leak current I51, does not disturb the constant-current supplying operation after activation.

The fourth embodiment operates in approximately the same manner as of the first embodiment and the constant-current source circuit 400 has the above mentioned advantages (A), (B) and (D).

Figure 5:
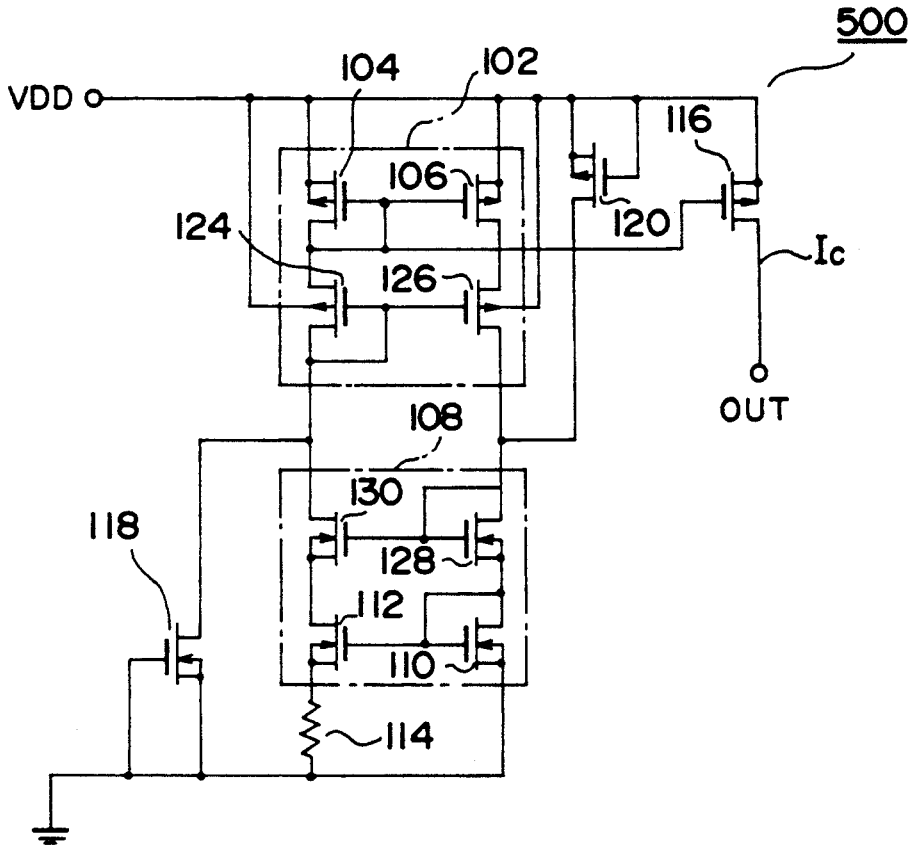
FIG. 5 is a circuit diagram of a constant-current source circuit illustrating a fifth embodiment according to the present invention.

FIG. 5 shows the fifth embodiment of the present invention, in which constant-current source circuit 500 differs from the constant-current source circuit 100 shown in FIG. 1 such that first current mirror circuit 102 includes two stages, supplementing the eighth and the ninth PMOS transistors 126 and 124.

In the constant-current source circuit 500, the second current mirror circuit 108 also includes two stages, supplementing the tenth and the eleventh NMOS transistors 128 and 130.

The fifth embodiment has similar effects as set forth in the first embodiment.

Further, constant-current source circuit 500 can minimize the dependency on the source-drain voltage of the drain current of each transistors in the first and second current mirror circuits, whereby the error of the current gains of current mirror circuits 102 and 108 can be reduced.

It is to be understood the present invention is not limited in its application to the foregoing embodiment shown in the accompanying drawings, and that various changes may be resorted to without departing from the spirit and scope thereof.

The constant-current source circuits 100, 200, 300, 400 and 500, for example, can be changed in respect to circuit diagrams, the ratio W/L or circuit constants including resistance value of resistors.

Following changes, for example, can be acceptable.

[1] The operational regions of the transistors 104, 106, 110 and 112 can be changed. The ratio W/L of the transistors and the current gain of the current mirror circuits can voluntarily be changed in accordance with a circuit design.

When the manufacturing deviation need not be considered, conductivity type of the sixth and seventh transistors 118 and 120 can be voluntarily changed.

A variety of modifications can be applied to construction of the current mirror circuits 102 and 108.

In the constant-current source circuits 100~500, a plurality of closed loop circuits can also be utilized, though a single closed loop circuit provides the constant-current Ic.

I claim:

1. A constant-current source circuit having a MOS transistor passing off-leak current comprising:

(a) a first fixed voltage terminal having a first voltage level;

(b) a second fixed voltage terminal having a second voltage level;

(c) an output terminal coupled to output a constant current;

(d) first and second nodes;

(e) a first current mirror circuit electrically coupled between the first fixed voltage terminal and said first and second nodes, and having a first current gain, said first current mirror circuit having a first current path passing a first current from said first fixed voltage terminal to said first node and a second current path passing a second current from said first fixed voltage terminal to said second node in accordance with the first current gain;

(f) a second current mirror circuit electrically coupled between the second fixed voltage terminal and said first and second nodes, and having a second current gain, said second current mirror circuit having a third current path passing a third current from said second node to said second fixed voltage terminal and a fourth current path passing a fourth current in accordance with the second current gain;

(g) a current gain variation resistor coupled between the fourth current path and said second fixed voltage terminal, for controlling the fourth current to control the second current gain;

(h) a first MOS transistor having a first conductivity type and passing a first off-leak current from said first fixed voltage terminal to said second node, the first MOS transistor including (1) a first gate electrode to which a predetermined voltage level is applied so as to keep the first MOS transistor in the off state, (2) a first electrode coupled to said first fixed voltage terminal, and (3) a second electrode coupled to said second node; and (i) an outputting circuit coupled between the output terminal and the first fixed voltage terminal, said outputting circuit having a control terminal coupled to the first current mirror circuit, for providing the constant current to the output terminal.

2. The constant-current source circuit set forth in claim 1, wherein the gate electrode of said first MOS transistor coupled to said second node.

3. The constant-current source circuit set forth in claim 1 wherein the first and second current paths are composed of a second and a third MOS transistors having the second conductivity type respectively, the gate electrodes of the second and third MOS transistors are commonly coupled to the drain electrode of the second MOS transistor, the source electrodes of the second and third MOS transistors are commonly coupled to said first fixed voltage terminal, the drain electrode of the second MOS transistor is coupled to said first node and said outputting circuit, and the drain electrode of the third MOS transistor is coupled to said second node.

4. The constant-current source circuit set forth in claim 1 wherein the third and the fourth current paths are composed of fourth and fifth MOS transistors having the first conductivity type respectively, the gate electrodes of the fourth and fifth MOS transistors are commonly coupled to the drain electrode of the fourth MOS transistor, the source electrode of the fourth MOS transistor is coupled to said second fixed voltage terminal, the source electrode of the fifth MOS transistor is coupled to said current gain variation register, the drain electrode of the fourth MOS transistor is coupled to said second node, the drain electrode of the fifth MOS transistor is coupled to said first node.

5. The constant-current source circuit set forth in claim 4, wherein a ratio of a gate width to gate length for the first MOS transistor is larger than that for the fourth MOS transistor.

6. The constant-current source circuit set forth in claim 1 wherein said first fixed voltage level is a Vdd level and said first MOS transistor is an N-type MOS transistor.

7. The constant-current source circuit set forth in claim 1 wherein said outputting circuit is composed of a sixth MOS transistor having the second conductivity type, and the sixth MOS transistor has a gate electrode coupled to the drain electrode of the second MOS transistor, a source electrode coupled to the first fixed voltage terminal, and a drain electrode coupled to the output terminal.

8. A constant-current source circuit having a MOS transistor passing off-leak current comprising:

(a) a first fixed voltage terminal having a first voltage level;

(b) a second fixed voltage terminal having a second voltage level;

(c) an output terminal coupled to output a constant current;

(d) first and second nodes;

(e) a first current mirror circuit electrically coupled between the first fixed voltage terminal and said first and second nodes, and having a first current gain, said first current mirror circuit having a first current path passing a first current from said first fixed voltage terminal to said first node and a second current path passing a second current from said first fixed voltage terminal to said second node in accordance with the first current gain;

(f) a second current mirror circuit electrically coupled between said second fixed voltage terminal and said first and second nodes, and having a second current gain, said second current mirror circuit having a third current path passing a third current from said second node to said second fixed voltage terminal and a fourth current path passing a fourth current in accordance with the second current gain;

(g) a current gain variation resistor coupled between the fourth current path and said second fixed voltage terminal, for controlling the fourth current to control the second current gain;

(h) a first MOS transistor having a first conductivity type and passing a first off-leak current from said first node to said second fixed voltage terminal, the first MOS transistor including (1) a first gate electrode to which a predetermined voltage level is applied so as to keep the first MOS transistor in the off state, (2) a first electrode coupled to said first node, and (3) a second electrode coupled to the second fixed voltage terminal; and (i) an outputting circuit coupled between said output terminal and the first fixed voltage terminal, said outputting circuit having a control terminal coupled to said first current mirror circuit, for providing the constant current to said output terminal.

9. The constant-current source circuit set forth in claim 8 wherein the gate electrode of said first MOS transistor is coupled to said first node.

10. The constant-current source circuit set forth in claim 8 wherein the first and the second current paths are composed of a second and a third MOS transistors respectively, both having the first conductivity type, the gate electrodes of the second and the third MOS transistors are commonly coupled to the drain electrode of the second MOS transistor, the source electrodes of the second and third MOS transistors are commonly coupled to said first fixed voltage terminal, the drain electrode of the second MOS transistor is coupled to said first node and said outputting circuit, and the drain electrode of the third MOS transistor is coupled to said second node.

11. The constant-current source circuit set forth in claim 8 wherein a ratio of a gate width to gate length for the first MOS transistor is larger than that for the second MOS transistor.

12. The constant-current source circuit set forth in claim 8 wherein the third and the fourth current paths are composed of a fourth and a fifth MOS transistors having the second conductivity type respectively, the gate electrodes of the fourth and fifth MOS transistors are commonly coupled to the drain electrode of the fourth MOS transistor, the source electrode of the fourth MOS transistor is coupled to said second fixed voltage terminal, the source electrode of the fifth MOS transistor is coupled to said current gain variation resistor, the drain electrode of the fourth MOS transistor is coupled to said second node, the drain electrode of the fifth MOS transistor is coupled to said first node.

13. The constant-current source circuit set forth in claim 8 wherein the first fixed voltage level is a Vdd level and said first MOS transistor is a P-type MOS transistor.

14. The constant-current source circuit set forth in claim 8 wherein said outputting circuit is composed of sixth MOS transistor having the first conductivity type and having a gate electrode coupled to the drain electrode of said second MOS transistor, a source electrode coupled to said first fixed voltage terminal, and a drain electrode coupled to said output terminal.

15. A constant-current source circuit having a MOS transistor passing off-leak current comprising:

(a) a first fixed voltage terminal having a first voltage level;

(b) a second fixed voltage terminal having a second voltage level;

(c) an output terminal coupled to output a constant current;

(d) first and second nodes;

(e) a first current mirror circuit electrically coupled between the first fixed voltage terminal and said first and second nodes, and having a first current gain, the first current mirror circuit having a first current path passing a first current from said first fixed voltage terminal to said first node and a second current path passing a second current from said first fixed voltage terminal to said second node in accordance with the first current gain;

(f) a second current mirror circuit electrically coupled between said second fixed voltage terminal and said first and second nodes, and having a second current gain, said second current mirror circuit having a third current path passing a third current from said second node to said second fixed voltage terminal and a fourth current path passing a fourth current in accordance with the second current gain;

(g) a current gain variation resistor coupled between the fourth current path and said second fixed voltage terminal, for controlling the fourth current to control the second current gain;

(h) a first MOS transistor having a first conductivity type and passing a first off-leak current from said first node to said second fixed voltage terminal, the first MOS transistor including:

(1) a first gate electrode to which a predetermined voltage level is applied so as to keep said first MOS transistor in the off state, (2) a first electrode coupled to said first node, and (3) a second electrode coupled to said second fixed voltage terminal;

(i) a second MOS transistor having a second conductivity type and passing a second off-leak current from said first fixed voltage terminal to said first node, the second MOS transistor including:

(1) a second gate electrode to which a predetermined voltage level is applied so as to keep said second MOS transistor in the off state, (2) a third electrode coupled to said first fixed voltage terminal, and (3) a fourth electrode coupled to said second node; and (j) an outputting circuit coupled between said output terminal and said first fixed voltage terminal, the outputting circuit having a control terminal coupled to said first current mirror circuit, for providing the constant current to said output terminal.

16. The constant-current source circuit set forth in claim 15 wherein the gate electrode of said second MOS transistor is coupled to said first fixed voltage terminal.

17. The constant-current source circuit set forth in claim 15 wherein the gate electrode of said first MOS transistor is coupled to the second fixed voltage terminal.

18. The constant-current source circuit set forth in claim 15, wherein the first and second current paths are composed of a third and a fourth MOS transistors having the second conductivity type respectively, the gate electrodes of the third and the fourth MOS transistors are commonly coupled to the drain electrode of the third MOS transistor, the source electrodes of the third and fourth MOS transistors are commonly coupled to said first fixed voltage terminal, the drain electrode of the third MOS transistor is coupled to said first node and said outputting circuit, and the drain electrode of the fourth MOS transistor is coupled to said second node.

19. The constant-current source circuit set forth in claim 18 wherein a ratio of a gate width to gate length for the first MOS transistor is larger than that for the third MOS transistor.

20. The constant-current source circuit set forth in claim 18 wherein the outputting circuit is composed of a seventh MOS transistor having the second conductivity type and the seventh MOS transistor has a gate electrode coupled to the drain electrode of the third MOS transistor, a source electrode coupled to the first fixed voltage terminal, and a drain electrode coupled to the output terminal.

21. The constant-current source circuit set forth in claim 15 wherein the third and the fourth current paths are composed of a fifth and a sixth MOS transistors having the first conductivity type respectively, the gate electrodes of the fifth and sixth MOS transistors are commonly coupled to the drain electrode of the fifth MOS transistor, the source electrode of the fifth MOS transistor is coupled to the second fixed voltage terminal, the source electrode of the sixth MOS transistor is coupled to the current gain variation resistor, the drain electrode of the fifth MOS transistor is coupled to said second node, and the drain electrode of the sixth MOS transistor is coupled to said first node.

22. The constant-current source circuit set forth in claim 21 wherein a ratio of a gate width to gate length for the second MOS transistor is larger than that for the fifth MOS transistor.

23. The constant-current source circuit set forth in claim 15 wherein the first fixed voltage level is a Vdd level and said first MOS transistor is an N-type MOS transistor.

* * * * *